US009463817B2

(12) United States Patent
Kupiec et al.

(10) Patent No.: US 9,463,817 B2
(45) Date of Patent: Oct. 11, 2016

(54) AUTOMATIC DISABLING OF UNPOWERED LOCKED WHEEL FAULT DETECTION FOR SLIPPED TRACTION MOTOR PINION

(71) Applicant: Electro-Motive Diesel, Inc., LaGrange, IL (US)

(72) Inventors: Gregory Raymond Kupiec, Lemont, IL (US); Dennis Melas, Chicago, IL (US); Isaac Suwa Traylor, Brookfield, IL (US)

(73) Assignee: Electro-Motive Diesel, Inc., La Grange, IL (US)

( * ) Notice: Subject to any disclaimer, the term of this patent is extended or adjusted under 35 U.S.C. 154(b) by 0 days.

(21) Appl. No.: 14/623,197

(22) Filed: Feb. 16, 2015

(65) Prior Publication Data

US 2016/0236698 A1 Aug. 18, 2016

(51) Int. Cl.

| | |
|---|---|
| ***G05D 1/00*** | (2006.01) |
| ***B61C 15/08*** | (2006.01) |
| ***B61L 15/00*** | (2006.01) |

(52) U.S. Cl.

CPC ..... *B61L 15/0081* (2013.01); *B61L 15/0072* (2013.01)

(58) Field of Classification Search

USPC ..... 701/19; 318/52

See application file for complete search history.

(56) References Cited

U.S. PATENT DOCUMENTS

| | | | | |
|---|---|---|---|---|
| 2,898,582 | A | 8/1959 | Lillquist | |
| 4,031,509 | A | 6/1977 | Matulevich | |
| 5,557,522 | A * | 9/1996 | Nakayama | G01C 21/3446 701/410 |
| 5,711,389 | A * | 1/1998 | Schlosser | B60K 17/36 180/197 |
| 6,532,405 | B1 * | 3/2003 | Kumar | B60L 3/00 104/288 |
| 7,051,044 | B1 * | 5/2006 | Fera | B61L 27/0094 |
| 2001/0035049 | A1 * | 11/2001 | Balch | B60L 3/10 73/488 |
| 2007/0001629 | A1 * | 1/2007 | McGarry | B60L 3/10 318/52 |
| 2007/0046220 | A1 * | 3/2007 | Alton | B60L 3/102 318/52 |
| 2008/0042602 | A1 * | 2/2008 | Kumar | B60L 15/20 318/66 |
| 2008/0051967 | A1 * | 2/2008 | Tarnow | B60L 3/10 701/71 |
| 2012/0160125 | A1 * | 6/2012 | Liberatore | B60L 3/0061 105/61 |
| 2013/0013138 | A1 * | 1/2013 | Lu | B60L 3/0061 701/22 |
| 2014/0139016 | A1 * | 5/2014 | Lovercheck | B60L 1/003 307/9.1 |

FOREIGN PATENT DOCUMENTS

| | | | | |
|---|---|---|---|---|
| AU | 2013263818 | A1 * | 7/2014 | B60L 3/00 |

* cited by examiner

*Primary Examiner* — Thomas G Black
*Assistant Examiner* — Tyler Paige
(74) *Attorney, Agent, or Firm* — Miller, Matthias & Hull LLP

(57) ABSTRACT

A method for detecting a slipped traction motor pinion in a locomotive is disclosed. The locomotive may have a traction system and a controller in communication with the traction system. The traction system may have a wheel axle, a traction motor operatively connected to the wheel axle, a speed sensor associated with the traction motor, an inverter coupled to the traction motor, and a current sensor associated with the inverter. The method may include monitoring signals indicative of a speed of the traction motor received from the speed sensor, receiving current feedback associated with the inverter received from the current sensor, comparing the signals from the speed sensor to the current feedback, and determining that the traction motor is decoupled from the wheel axle based on the comparison of the signals from the speed sensor to the current feedback.

19 Claims, 5 Drawing Sheets

AUTOMATIC DISABLING OF UNPOWERED LOCKED WHEEL FAULT DETECTION FOR SLIPPED TRACTION MOTOR PINION

FIELD OF THE DISCLOSURE

The present disclosure relates generally to locomotives and, more particularly, to slipped traction motor pinion detection systems for locomotives.

BACKGROUND OF THE DISCLOSURE

Freight trains and passenger trains generally include a locomotive that provides the motive power for a train. Having no payload capacity of its own, the sole purpose of the locomotive is to move the train along the tracks. Typically, the locomotive may use an engine to drive a primary power source, such as, a main generator or an alternator. Converting mechanical energy into electrical energy, the primary power source provides power to traction motors in order to drive wheels of the locomotive. The traction motors propel the train along the tracks.

One or more wheels of the locomotive can become locked due to various reasons, such as gear train issues, inadvertent application of the parking brakes during operation, etc. In order to detect a locked wheel, locomotives may have locked wheel fault detection systems. A locked wheel fault detection system may use speed probes to monitor a speed of each of the traction motors. For example, when one of the speed probes detects a speed of zero, while the other speed probes detect a nonzero speed, the system may detect a locked wheel.

However, in some instances, a traction motor pinion may be slipped, resulting in the traction motor becoming mechanically decoupled from the gear case and wheel axle. Due to the decoupling of the wheel axle from the traction motor, the locked wheel fault detection system may not have the ability to detect a locked wheel. In particular, the system has no feedback related to the actual speed of the wheel axle that is decoupled from the traction motor with the slipped pinion.

A method for detecting a potentially locked wheel axle on a vehicle propelled by an AC motor is disclosed in U.S. Pat. No. 6,532,405, entitled, "Method for Detecting a Locked Axle on a Locomotive AC Traction Motor." The '405 patent describes conducting a speed test by estimating axle speed and comparing the estimated axle speed to a measured vehicle speed. The existence of a potential locked axle condition is determined based on the comparison of estimated axle speed to measured vehicle speed. While effective for detecting a potential locked axle condition, the '405 method does not detect whether a traction motor pinion is slipped. Improvements are desired to determine whether a traction motor is mechanically decoupled from a wheel axle.

SUMMARY OF THE DISCLOSURE

In accordance with one embodiment, a method for detecting a slipped traction motor pinion in a locomotive is disclosed. The locomotive may have a traction system and a controller in communication with the traction system. The traction system may have a wheel axle, a traction motor operatively connected to the wheel axle, a speed sensor associated with the traction motor, an inverter coupled to the traction motor, and a current sensor associated with the inverter. The method may include monitoring signals indicative of a speed of the traction motor received from the speed sensor, receiving current feedback associated with the inverter received from the current sensor, comparing the signals from the speed sensor to the current feedback, and determining that the fraction motor is decoupled from the wheel axle based on the comparison of the signals from the speed sensor to the current feedback.

In accordance with another embodiment, a system for detecting a slipped traction motor pinion in a locomotive is disclosed. The locomotive may have a traction system and a controller in communication with the traction system. The traction system may have a plurality of wheel axles, each of the plurality of wheel axles having a fraction motor operatively connected thereto, and each fraction motor having an inverter coupled thereto. The system for detecting a slipped traction motor pinion may include a speed sensor associated with each of the traction motors, each speed sensor configured to detect a speed of the associated traction motor; a current sensor associated with each of the inverters, each current sensor configured to detect a current of the associated inverter; and a controller in communication with each speed sensor and each current sensor.

The controller may be configured to monitor signals indicative of a speed of each traction motor received from the speed sensors, receive signals indicative of a current of each inverter received from the current sensors, compare the signals from the speed sensors to the signals from the current sensors, determine if one of the traction motors is decoupled from the wheel axle based on the comparison of the signals from the speed sensors to the signals from the current sensors, and disable a locked wheel fault detection when one of the fraction motors is decoupled from the wheel axle.

In accordance with yet another embodiment, a method for detecting a slipped traction motor pinion in a locomotive and disabling a locked wheel fault detection is disclosed. The locomotive may have a traction system and a controller in communication with the traction system. The traction system may have a wheel axle, a traction motor operatively connected to the wheel axle, a speed sensor associated with the traction motor, an inverter coupled to the traction motor, and a current sensor associated with the inverter. The method may include monitoring signals indicative of a speed of the traction motor received from the speed sensor, receiving current feedback associated with the inverter received from the current sensor, determining the traction motor is decoupled from the wheel axle when signals from the speed sensor indicate a substantial traction motor speed and the current feedback indicates an insignificant load on the traction motor, and disabling the locked wheel fault detection.

These and other aspects and features will become more readily apparent upon reading the following detailed description when taken in conjunction with the accompanying drawings. In addition, although various features are disclosed in relation to specific exemplary embodiments, it is understood that the various features may be combined with each other, or used alone, with any of the various exemplary embodiments without departing from the scope of the disclosure.

While the present disclosure is susceptible to various modifications and alternative constructions, certain illustrative embodiments thereof will be shown and described below in detail. The disclosure is not limited to the specific embodiments disclosed, but instead includes all modifications, alternative constructions, and equivalents thereof.

DETAILED DESCRIPTION

The present disclosure provides a system and method for detecting a slipped traction motor pinion in a locomotive. The disclosed system and method determine whether a traction motor is decoupled from a wheel axle by monitoring both speed sensor signals and electrical feedback from the traction motors. More specifically, the system and method compare the speed sensor signals to current feedback from the traction motors. By also analyzing current feedback from the traction motors, the disclosed system and method can determine whether there is a load on the traction motor, and therefore, determine whether the traction motor is coupled or decoupled to the wheel axle. In addition, the disclosed system and method disable a locked wheel fault detection when the traction motor is determined to be decoupled from the wheel axle.

Reference will now be made in detail to specific embodiments or features, examples of which are illustrated in the accompanying drawings. Generally, corresponding reference numbers will be used throughout the drawings to refer to the same or corresponding parts.

Figure 1:
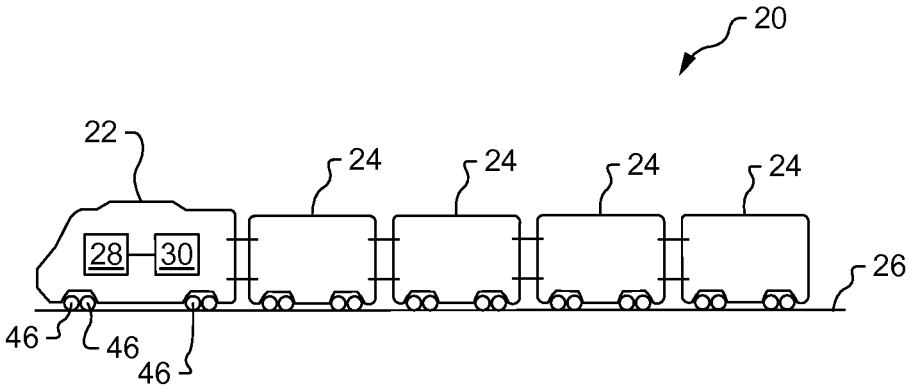
FIG. 1 is a diagrammatic view of vehicle, in accordance with one embodiment of the present disclosure.

FIG. 1 illustrates a vehicle 20 consistent with certain embodiments of the present disclosure. Although vehicle 20 is illustrated as a rail transport vehicle, the vehicle 20 may be any type of vehicle or machine used to perform a driven operation involving physical movement associated with a particular industry, such as, without limitation, transportation, mining, construction, landscaping, forestry, agriculture, etc.

Non-limiting examples of vehicles and machines, for both commercial and industrial purposes, include trains, diesel-electric locomotives, diesel mechanical locomotives, mining vehicles, on-highway vehicles, earth-moving vehicles, loaders, excavators, dozers, motor graders, tractors, trucks, backhoes, agricultural equipment, material handling equipment, marine vessels, and other types that operate in a work environment. It is to be understood that the vehicle 20 is shown primarily for illustrative purposes to assist in disclosing features of various embodiments, and that FIG. 1 does not depict all of the components of a vehicle.

The vehicle 20 may include a locomotive 22 coupled to at least one railcar 24. The vehicle 20 may travel along a route 26, such as, one or more rails of a track. Railcars 24 may be passenger cars or freight cars for carrying passengers, goods, or other loads. The locomotive 22 may include an engine 28, or other power source, and a power system 30. The engine 28 may be electric, diesel, steam, hydrogen, gas turbine powered, hybrid, or of any other type for generating energy to propel the vehicle 20. Power system 30 may be configured to distribute electrical power to propulsion and non-propulsion electric loads.

Figure 2:
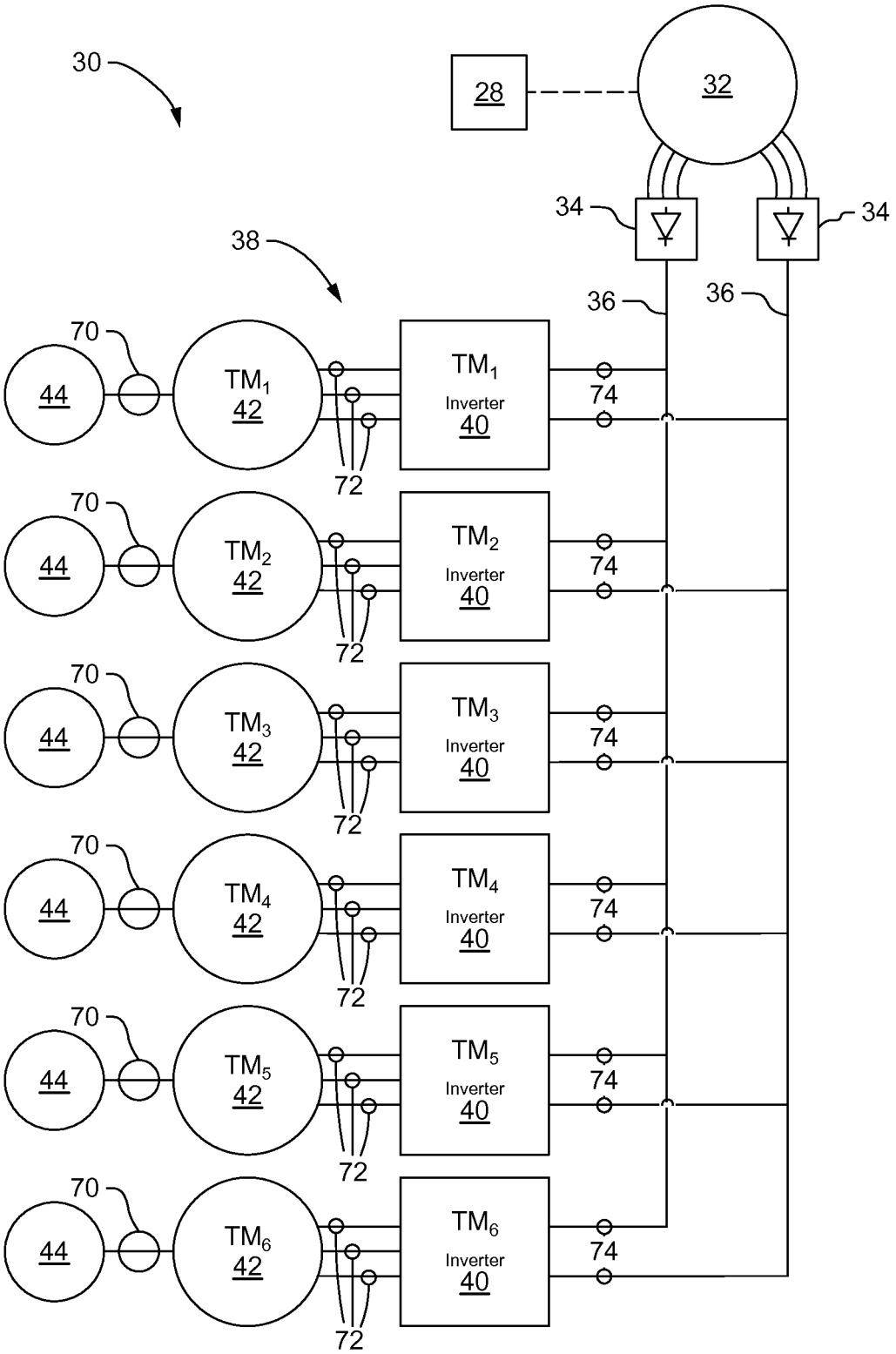
FIG. 2 is a diagrammatic view of part of a power system for the vehicle of FIG. 1.

Referring now to FIG. 2, with continued reference to FIG. 1, a diagrammatic view of part of the power system 30 is shown, in accordance with an embodiment of the present disclosure. It is to be understood that only part of the power system 30 is shown primarily for illustrative purposes to assist in disclosing features of various embodiments, and that FIG. 2 does not depict all of the components of a power system. The power system 30 may include an alternator 32 operatively coupled to the engine 28. The alternator 32 may convert mechanical energy generated by the engine 28 into electrical energy in the form of alternating current (AC). However, other types of generators than alternator 32 may be used. At the output of the alternator 32, rectifiers 34 may convert AC to direct current (DC) that is conveyed on DC links 36.

The power system 30 may further include a traction system 38. The traction system 38 may be configured to move the locomotive 22 and propel the vehicle 20 along the route 26. For example, DC link 36 may convey DC to the traction system 38. The traction system 38 may include inverters 40 to convert DC into AC for traction motors 42 configured to drive wheel axles 44 of the locomotive 22. Although, in FIG. 2, the traction system 38 includes six inverters 40 and six fraction motors 42, one inverter 40 per individual fraction motor 42, and one traction motor 42 per wheel axle 44, it is to be understood that other configurations are certainly possible. For example, the fraction system 38 may include multiple traction motors 42 in parallel, powered from a single inverter 40.

Figure 3:
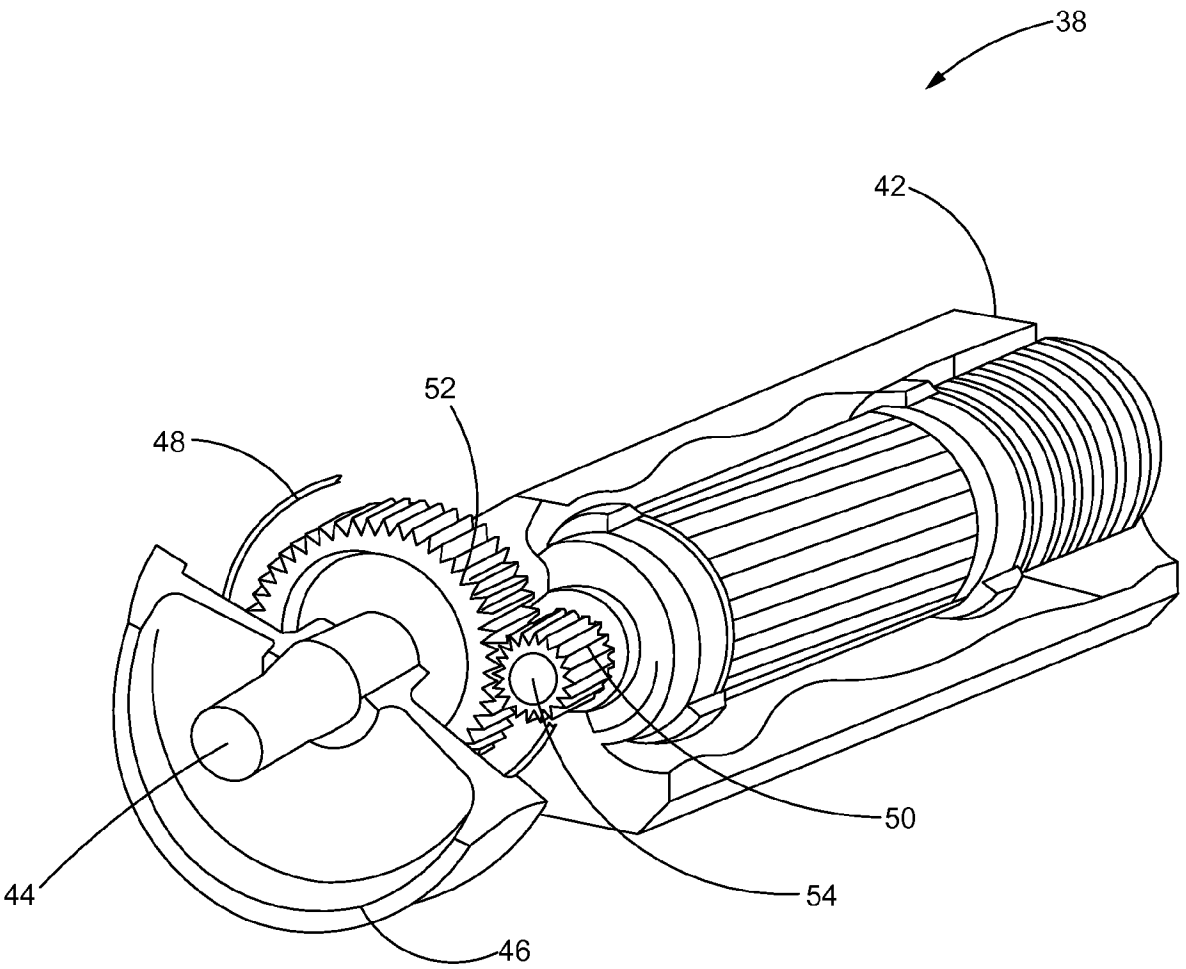
FIG. 3 is a perspective view of part of a traction system for the vehicle of FIG. 1.

Referring now to FIG. 3, with continued reference to FIGS. 1 and 2, a perspective view of part of the traction system 38 is shown. A pair of wheels 46 may be attached to each end of the wheel axle 44. Each wheel axle 44 may be rotatably coupled to the traction motor 42, such as, via gear case 48. The gear case 48 may include a pinion 50 and axle gear 52 in meshing engagement. Mounted to a motor shaft 54 of the traction motor 42, the pinion 50 may drive the axle gear 52 mounted to the wheel axle 44.

Figure 4:
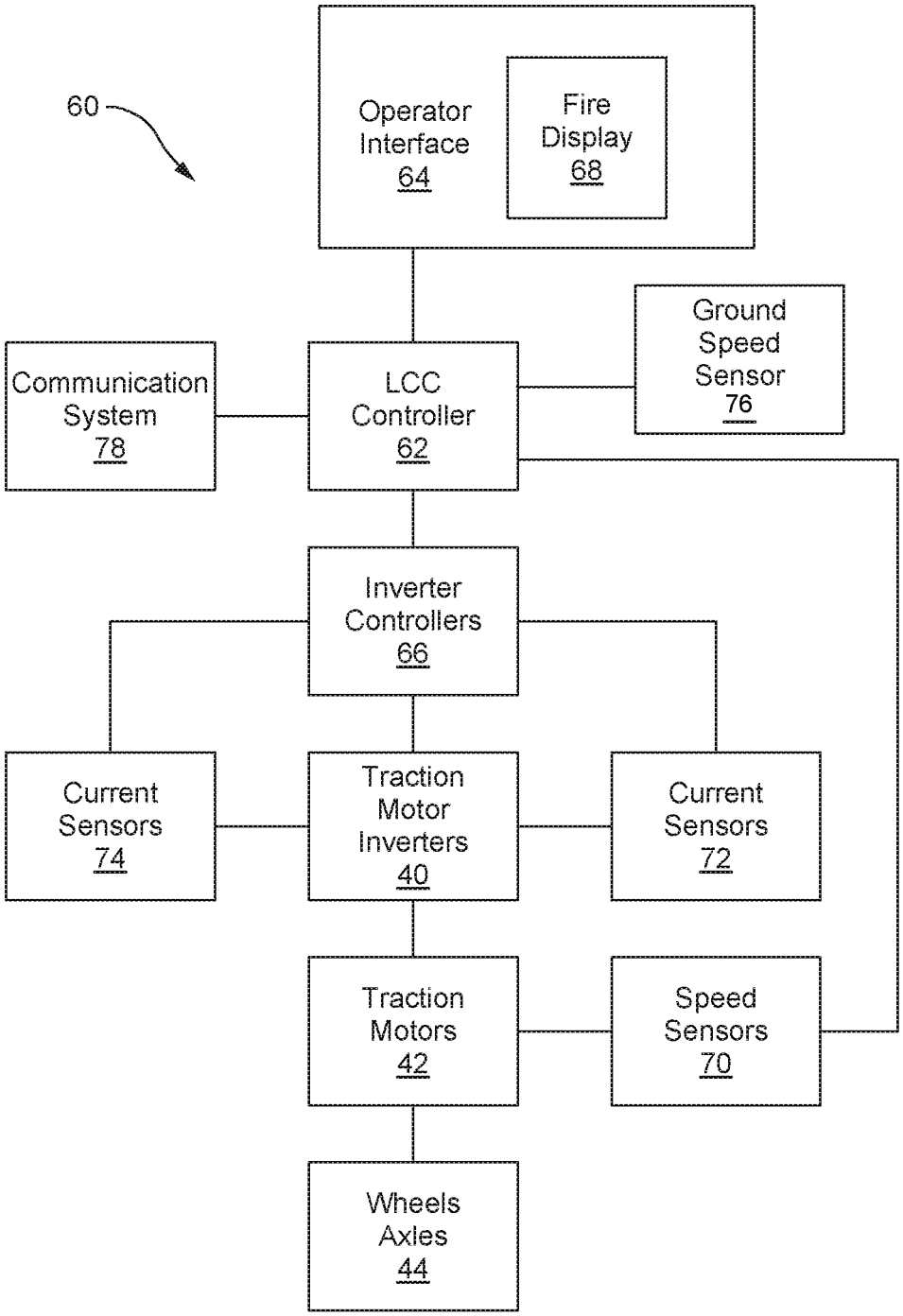
FIG. 4 is a schematic representation of a system for detecting a slipped traction motor pinion in a locomotive, in accordance with another embodiment of the present disclosure.

Turning now to FIG. 4, with continued reference to FIGS. 1-3, a diagrammatic view of a system 60 for detecting a slipped traction motor pinion in the locomotive 22 is shown, according to an embodiment of the present disclosure. The system 60 may be implemented using one or more of a processor, a microprocessor, a microcontroller, a digital signal processor (DSP), a field-programmable gate array (FGPA), an electronic control module (ECM), an electronic control unit (ECU), and a processor-based device that may include or be associated with a non-transitory computer readable storage medium having stored thereon computer-executable instructions, or any other suitable means for electronically controlling functionality of the locomotive 22. Other hardware, software, firmware, or combinations thereof may be included in the system 60. In addition, the system 60 may be configured to operate according to predetermined algorithms or sets of instructions programmed or incorporated into memory that is associated with or at least accessible to the system 60.

For example, the system 60 may comprise a controller 62, such as, a locomotive control computer (LCC), in communication with an operator interface 64 and inverter controllers 66. In one embodiment, the controller 62 may comprise an Electro-Motive EM2000 device, although other devices for the controller 62 may be used. The operator interface 64 may be configured to receive input from and output data to an operator of the locomotive 22. For example, the operator interface 64 may include a Functionality Integrated Railroad Electronics (FIRE) display 68. However other operator controls may be included in the operator interface 64, such as, without limitation, one or more pedals, joysticks, buttons, switches, dials, levers, steering wheels, keyboards, touchscreens, displays, monitors, screens, lights, speakers, horns, sirens, buzzers, alarm bells, voice recognition software, microphones, control panels, instrument panels, gauges, etc.

In communication with the controller 62, inverter controllers 66 may perform control and protection functions related to inverters 40. Each of the inverters 40 may be in communication with a single inverter controller. In addition, each of the inverter controllers 66 may be configured to read sensor inputs from the inverters 40, receive and send signals to and from the controller 62. For example, each of the inverter controllers 66 may comprise an A4P1 device or an A5P1 device, although other devices may be used. It is to be understood that although controller 62 and inverter controllers 66 are shown as separate controllers, other configurations may be used as well.

The system 60 may further comprise a speed sensor 70 and at least one current sensor 72 associated with each traction motor 42. The speed sensors 70 may be configured to detect a speed of the associated fraction motors 42 and send corresponding signals to the controller 62. For example, the speed sensor 70 may detect a rotational speed of the motor shaft 54 (FIG. 3). However, other sensors detecting the gear train, axle, wheel speed, or other parts of the motor may also be used.

The current sensors 72 may be configured to detect a current of the associated inverters 40 and send corresponding signals to the inverter controller 66. The controller 62 may receive corresponding signals from the inverter controller 66 indicating the same. For example, the current sensor 72 may measure AC from the inverter 40 to the traction motor 42. However, other sensors detecting electrical feedback, such as voltage, flux, or other currents associated with the inverter and traction motor may also be used. For instance, current sensors 74 may measure DC input into the inverter 40.

In addition, the system 60 may include at least one ground speed sensor 76. The ground speed sensor 76 may be configured to detect a ground speed of the locomotive 22 and send corresponding signals to the controller 62. The ground speed of the locomotive 22 may refer to a horizontal speed of the locomotive 22 relative to the ground. For instance, the ground speed sensor 76 may comprise a radar sensor, a global positioning system (GPS) sensor, and other types of sensors.

INDUSTRIAL APPLICABILITY

In general, the foregoing disclosure finds utility in various industrial applications, such as, in transportation, mining, earthmoving, construction, industrial, agricultural, and forestry vehicles and machines. In particular, the disclosed load management system may be applied to locomotives, trains, mining vehicles, on-highway vehicles, earth-moving vehicles, loaders, excavators, dozers, motor graders, tractors, trucks, backhoes, agricultural equipment, material handling equipment, marine vessels, and the like.

Figure 5:
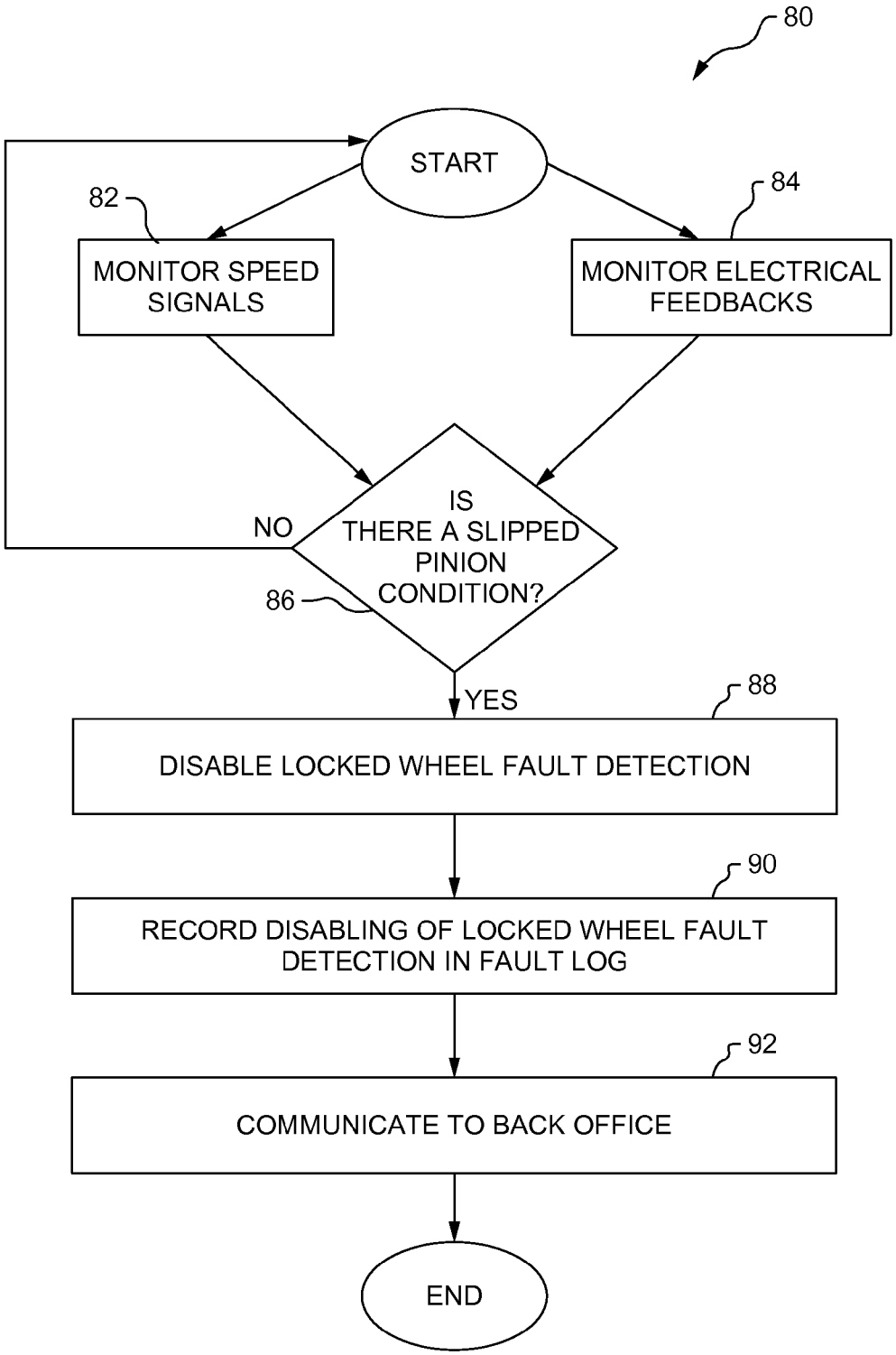
FIG. 5 is a flowchart illustrating a process for detecting a slipped traction motor pinion in a locomotive and disabling a locked wheel fault detection, in accordance with yet another embodiment.

Turning now to FIG. 5, with continued reference to FIGS. 1-4, a flowchart illustrating an example process 80 for detecting a slipped traction motor pinion in the locomotive 22 and disabling a locked wheel fault detection is shown, according to another embodiment of the present disclosure. The process 80 may be programmed into the memory associated with the controller 62 of the locomotive 22. At block 82, the controller 62 may monitor signals from the speed sensors 70 and the ground speed sensor 76.

For example, the controller 62 may receive signals from each speed sensor 70 associated with the different traction motors 42, and compare those signals to each other. The controller 62 may determine whether signals from one speed sensor 70 for one traction motor 42 are consistent with signals from the other speed sensors 70 for the other traction motors 42. For instance, based on the signals from the speed sensors 70, the controller 62 may determine that the motor shafts 54 of all the fraction motors 42 are running at a same speed.

The controller 62 may also compare signals from the speed sensors 70 to signals from the ground speed sensor 76. The controller 62 may determine whether signals from each of the speed sensors 70 are consistent with signals from the ground speed sensor 76. For example, based on the signals from the speed sensors 70 and the ground speed sensor 76, the controller 62 may determine that the motor shafts 54 of all the traction motors 42 are running at a speed that correlates to the ground speed of the locomotive 22.

At block 84, the controller 62 may simultaneously monitor electrical feedback from the traction system 38. More specifically, the controller 62 may monitor current feedback based on signals from the current sensors 72, 74. The controller 62 may compare the signals from the speed sensors 70 with the current feedback from the current sensors 72, 74. For example, the controller 62 may determine whether the current feedback is consistent with signals from the speed sensors 70. In one example, the current feedback from one inverter 40 may indicate an insignificant load on the associated traction motor 42, while the signals from the speed sensor 70 for the same traction motor 42 may indicate a substantial traction motor speed, and therefore, the controller 62 may determine that the traction motor 42 is decoupled from the associated wheel axle 44.

Furthermore, if signals from all the speed sensors 70 are consistent with each other, such as, when all the motor shafts 54 of the traction motors 42 are running at a same substantial speed, and the current feedback from one inverter 40 indicates an insignificant load on the associated traction motor 42, the controller 62 may confirm that the associated fraction motor 42 is decoupled from the associated wheel axle 44. In addition, if signals from all the speed sensors 70 are consistent with signals from the ground speed sensor 76, such as, when all the motor shafts 54 of the traction motors 42 are running at the same substantial speed that correlates to a substantial ground speed of the locomotive 22, and the current feedback from the one inverter 40 indicates an insignificant load on the associated traction motor 42, the controller 62 may further confirm that the associated traction motor 42 is decoupled from the associated wheel axle 44.

The controller 62 may also compare signals from each of the current sensors 72, 74 associated with the different traction motors 42, and compare those signals to each other. The controller 62 may determine whether current feedback from one inverter 40 is consistent with current feedback from the other inverters 40. For instance, based on the signals from all the current sensors 72, 74, the controller 62 may determine that there is an insignificant load on one of the traction motors 42, while there are substantial loads on the other traction motors 42, thereby further confirming that the traction motor 42 with the insignificant load is decoupled from the associated wheel axle 44.

At block 86, if the controller 62 does not detect any decoupling of the traction motors 42 from the wheel axles 44, then the process 80 proceeds back to start. At block 86, if the controller 62 determines that one of the traction motors 42 is decoupled from the associated wheel axle 44, such as, when there is a slipped traction motor pinion condition, then the process 80 proceeds to block 88.

At block 88, the controller 62 may disable a locked wheel fault detection upon determination of the slipped traction motor pinion condition. With one of the traction motors 42 decoupled from the associated wheel axle 44, the controller 62 may not have accurate feedback related to the actual speed of the wheel axle 44, thereby preventing the controller 62 from detecting a locked wheel. Therefore, the controller 62 may disable the locked wheel fault detection algorithm. For example, the controller 62 may disable the entire locked wheel fault detection algorithm for all of the traction motors 42. In another example, the controller 62 may selectively disable a part of the locked wheel fault detection algorithm related to the one fraction motor 42 that is decoupled from the associated wheel axle 44.

In addition, the controller 62 may record the disabling of the locked wheel fault detection in a fault log, at block 90. At block 92, the controller 62 may be configured to communicate the disabling of the locked wheel fault detection to an off-board location. For instance, the system 60 may further include a communication system 78 (FIG. 4), which connects to off-board components, such as through cellular, Wi-Fi, and other wired or wireless communication devices. In an example, the communication system 78 may send the fault log to a back office where railroad personnel can view data and operating conditions at the time of the disabling of the locked wheel fault detection.

The controller 62 may also enable a fault annunciation of the slipped traction motor pinion condition. The fault annunciation may comprise alerting an operator of the locomotive 22 or other personnel that the system 60 detected a traction motor decoupled from its wheel axle, or a slipped fraction motor pinion. The fault annunciation may also include an indication of which specific traction motor 42 and wheel axle 44 on the locomotive 22 is decoupled. For example, a message may be displayed on the FIRE display 58, an alarm bell may ring, and/or the slipped traction motor pinion condition may be recorded in the fault log. Other various annunciations may be performed as well.

It is to be understood that the flowchart in FIG. 5 is shown and described as an example only to assist in disclosing the features of the disclosed system, and that more or less steps than that shown may be included in the method corresponding to the various features described above for the disclosed system without departing from the scope of the disclosure.

By applying the disclosed system and method to a locomotive, the decoupling of a traction motor from its associated wheel axle, such as the occurrence of a slipped traction motor pinion, may be detected. In particular false positive locked wheel detection due to faulty speed probes is eliminated. In particular, the disclosed system and method determine whether a traction motor is decoupled from a wheel axle by monitoring both speed sensor signals and electrical feedback from the traction motors. By diagnosing when a traction motor is decoupled from its associated wheel axle, the disclosed system and method significantly reduce the time and cost of repair for the locomotive.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A method for detecting a slipped traction motor pinion in a locomotive having a traction system and a controller in communication with the traction system, the traction system having a wheel axle, a traction motor operatively connected to the wheel axle, a speed sensor associated with the traction motor, an inverter coupled to the traction motor, and a current sensor associated with the inverter, the method comprising:

receiving, within the controller, a signal from the speed sensor, the signal from the speed sensor being indicative of a speed of the traction motor;

receiving, within the controller, current feedback from the current sensor, the current feedback being indicative of an electrical current through the inverter;

comparing, via the controller, the signal from the speed sensor to the current feedback; and determining, via the controller, that the traction motor is decoupled from the wheel axle when the signal from the speed sensor indicates a substantial traction motor speed, and the current feedback indicates an insignificant load on the traction motor.

2. The method of claim 1, further comprising disabling, via the controller, a locked wheel fault detection upon determining that the traction motor is decoupled from the wheel axle.

3. The method of claim 2, further comprising recording the disabling of the locked wheel fault detection in a fault log.

4. The method of claim 3, further comprising sending the fault log to an off-board location via a communication system.

5. The method of claim 1, wherein the locomotive includes a plurality of traction motors and a plurality of speed sensors, each speed sensor of the plurality of speed sensors being uniquely associated with one traction motor of the plurality of traction motors, the traction motor is a first traction motor of the plurality of traction motors, the speed sensor is a first speed sensor of the plurality of speed sensors, and the determining the traction motor is decoupled from the wheel axle includes comparing the signal from the first speed sensor to signals from other speed sensors of the plurality of speed sensors, and determining that the first traction motor speed is substantial when the first traction motor speed is consistent with speeds of other traction motors of the plurality of traction motors.

6. The method of claim 5, wherein the locomotive further includes a plurality of inverters, each inverter being uniquely coupled with one traction motor of the plurality of traction motors, the inverter is a first inverter of the plurality of inverters, and the determining the traction motor is decoupled from the wheel axle further includes comparing current feedback for the first inverter with current feedback associated with other inverters of the plurality of inverters, and determining that a load on the first traction motor is insignificant when an electrical current through the first inverter is less than an electrical current through another inverter of the plurality of inverters.

7. The method of claim 1, wherein the locomotive includes a plurality of traction motors and a plurality of speed sensors, each speed sensor of the plurality of speed sensors being uniquely associated with one traction motor of the plurality of traction motors, the traction motor is a first traction motor of the plurality of traction motors, the speed sensor is a first speed sensor of the plurality of speed sensors, and the determining the traction motor is decoupled from the wheel axle includes comparing the signal from the first speed sensor to a signal indicative of a ground speed of the locomotive, and determining that the first traction motor speed is substantial when the first traction motor speed is consistent with a ground speed of the locomotive.

8. The method of claim 7, wherein the locomotive further includes a plurality of inverters, each inverter being uniquely coupled with one traction motor of the plurality of traction motors, the inverter is a first inverter of the plurality of inverters, and the determining the traction motor is decoupled from the wheel axle further includes comparing current feedback for the first inverter with current feedback associated with other inverters of the plurality of inverters, and determining that a load on the first traction motor is insignificant when an electrical current through the first inverter is less than an electrical current through another inverter of the plurality of inverters.

9. A system for detecting a slipped traction motor pinion in a locomotive having a traction system and a controller in communication with the traction system, the traction system having a plurality of wheel axles, each wheel axle of the plurality of wheel axles having one traction motor of a plurality of traction motors operatively connected thereto, each traction motor of the plurality of traction motors having one inverter of a plurality of inverters coupled thereto, the system for detecting the slipped traction motor pinion comprising:

a plurality of speed sensors, each speed sensor of the plurality of speed sensors being associated with one of the traction motors, each speed sensor being configured to generate a signal indicative of a speed of an associated traction motor;

a plurality of current sensors, each current sensor of the plurality of current sensors being associated with one inverter of the plurality of inverters, each current sensor being configured to generate a signal indicative of a current through the associated inverter; and a controller in communication with each speed sensor and each current sensor, the controller being configured to:

receive from the speed sensors the signals indicative of the speed of each traction motor, receive from the current sensors the signals indicative of the current through each inverter, compare the signals from the speed sensors to the signals from the current sensors, determine if a first traction motor of the plurality of traction motors is decoupled from a first wheel axle of the plurality of wheel axles when the signal from a first speed sensor of the plurality of speed sensors indicates substantial traction motor speed for the first traction motor, and the signal from a first current sensor of the plurality of current sensors indicates an insignificant load on the first traction motor, and disable a locked wheel fault detection when the first traction motor is decoupled from the first wheel axle.

10. The system for detecting the slipped traction motor pinion of claim 9, wherein each speed sensor of the plurality of speed sensors is configured to detect a speed of a motor shaft of one traction motor of the plurality of traction motors.

11. The system for detecting the slipped traction motor pinion of claim 10, wherein the controller is further configured to determine if the first traction motor is decoupled from the first wheel axle when signals from all speed sensors of the plurality of speed sensors are consistent with each other, and the signal from the first current sensor indicates an insignificant load on the first traction motor compared to loads on other traction motors of the plurality of traction motors.

12. The system for detecting the slipped traction motor pinion of claim 11, further comprising a ground speed sensor in communication with the controller, the ground speed sensor being configured to generate a signal that is indicative of a ground speed of the locomotive.

13. The system for detecting the slipped traction motor pinion of claim 12, wherein the ground speed sensor is at least one of a radar sensor and a global positioning system (GPS) sensor.

14. The system for detecting the slipped traction motor pinion of claim 12, wherein the controller is further configured to determine if the first traction motor is decoupled from the first wheel axle when signals from all speed sensors of the plurality of speed sensors are consistent with the signal from the ground speed sensor, and the signal from the first current sensor indicates an insignificant load on the first traction motor compared to loads on other traction motors of the plurality of traction motors.

15. The system for detecting the slipped traction motor pinion of claim 14, wherein the controller is further configured to record the disabling of the locked wheel fault detection in a fault log.

16. The system for detecting the slipped traction motor pinion of claim 15, wherein the controller is further configured to send the fault log to an off-board location via a communication system.

17. A method for detecting a slipped traction motor pinion in a locomotive and disabling a locked wheel fault detection, the locomotive having a traction system and a controller in communication with the traction system, the traction system having a wheel axle, a traction motor operatively connected to the wheel axle, a speed sensor associated with the traction motor, an inverter coupled to the traction motor, and a current sensor associated with the inverter, the method comprising:

receiving, within the controller, a signal from the speed sensor, the signal from the speed sensor being indicative of a speed of the traction motor;

receiving, within the controller, current feedback from the current sensor, the current feedback being indicative of an electrical current through the inverter;

determining, via the controller, that the traction motor is decoupled from the wheel axle when the signal from the speed sensor indicates a substantial traction motor speed, and the current feedback indicates an insignificant load on the traction motor; and disabling, via the controller, the locked wheel fault detection.

18. The method of claim 17, wherein the locomotive includes a plurality of traction motors and a plurality of speed sensors, each speed sensor of the plurality of speed sensors being uniquely associated with one traction motor of the plurality of traction motors, the traction motor is a first traction motor of the plurality of traction motors, the speed sensor is a first speed sensor of the plurality of speed sensors, and the determining the traction motor is decoupled from the wheel axle includes comparing the signal from the first speed sensor to signals from other speed sensors of the plurality of speed sensors, and determining that the first traction motor speed is substantial when the first traction motor speed is consistent with speeds of other traction motors of the plurality of traction motors.

19. The method of claim 18, wherein the locomotive further includes a plurality of inverters, each inverter being uniquely coupled with one traction motor of the plurality of traction motors, the inverter is a first inverter of the plurality of inverters, and the determining the traction motor is decoupled from the wheel axle further includes comparing current feedback for the first inverter with current feedback associated with other inverters of the plurality of inverters, and determining that a load on the first traction motor is insignificant when an electrical current through the first inverter is less than an electrical current through another inverter of the plurality of inverters.

* * * * *